US010106381B2

(12) United States Patent
Lockwood

(10) Patent No.: US 10,106,381 B2
(45) Date of Patent: Oct. 23, 2018

(54) PORTABLE ENDLESS LINE PULLER

(71) Applicant: Brian Douglas Lockwood, West Linn, OR (US)

(72) Inventor: Brian Douglas Lockwood, West Linn, OR (US)

( * ) Notice: Subject to any disclaimer, the term of this patent is extended or adjusted under 35 U.S.C. 154(b) by 143 days.

(21) Appl. No.: 15/291,682

(22) Filed: Oct. 12, 2016

(65) Prior Publication Data

US 2018/0099844 A1 Apr. 12, 2018

(51) Int. Cl.

| | |
|---|---|
| ***B66D 1/74*** | (2006.01) |
| ***B66D 1/24*** | (2006.01) |
| ***B66D 5/16*** | (2006.01) |
| *B66D 1/12* | (2006.01) |

(52) U.S. Cl.

CPC ..... *B66D 1/7484* (2013.01); *B66D 1/24* (2013.01); *B66D 5/16* (2013.01); *B66D 1/12* (2013.01)

(58) Field of Classification Search

CPC ..... B66D 1/24; B66D 1/74; B66D 1/7415; B66D 1/7421–1/7457; B66D 1/7468; B66D 1/7473; B66D 1/7478; B66D 1/7484; B66D 5/06; B66D 5/16

See application file for complete search history.

(56) References Cited

U.S. PATENT DOCUMENTS 3,281,120 A * 10/1966 Richardson ..... B66D 1/7431 254/376
3,682,442 A * 8/1972 Baldwin ..... B66D 1/7431 192/12 B
3,843,094 A * 10/1974 Watts ..... B66D 1/36 242/366
3,910,557 A * 10/1975 Merriman ..... B66D 1/7431 254/369
4,651,974 A * 3/1987 Frommherz ..... B66D 1/7405 242/364.2
5,386,970 A * 2/1995 Trant ..... B25F 5/00 254/344
5,971,363 A * 10/1999 Good ..... A01G 23/099 254/266
7,380,770 B2 * 6/2008 Tzeng ..... B66D 3/12 254/358
7,448,597 B2 * 11/2008 Jacobson ..... B66B 9/00 254/274
7,484,713 B1 * 2/2009 Young ..... B66D 1/04 254/334
7,717,402 B2 * 5/2010 Mann ..... B66D 1/7484 242/397.2
9,150,392 B2 * 10/2015 Skyba ..... B66D 1/7452
9,206,022 B2 * 12/2015 Burneister ..... B66D 1/28

* cited by examiner

*Primary Examiner* — Sang K Kim
*Assistant Examiner* — Nathaniel L Adams

(57) ABSTRACT

A line puller designed to accept a Working line (15) through a Working Line Fairlead (14), directing the line around a Capstan (21), and through a brake (28). This line puller is mainly driven by gears or friction rotational devices (38), driving the internal face or cogs (36) of a Capstan. The design allows users to load a Working Line (15) from midsection not requiring the end of the line to load the puller. The puller can be hard mounted or Soft mounted using an Anchor Line (44) fed through incorporated Anchor Fairleads (20). Multiple gear rations allow users to pull objects at different rates.

1 Claim, 4 Drawing Sheets

PORTABLE ENDLESS LINE PULLER

The following is tabulation of some prior art that presently appears relevant:

U.S. patents

| | |
|---|---|
| 9,150,392 B66D | Oct. 16, 2015 Skyba |
| 7,3934,698 B66D | May 3, 2011 Ball |
| 3,843,094 B66D | Oct. 22, 1974 Watts |
| 4,651,974 B66D | Mar. 24, 1987 Frommherz |
| 5,971,363 A01G | Oct. 26, 1999 Good |
| 7,380,770 B66D | Jun. 3, 2008 Yeong-Guang |
| 7,448,597 B66D | Nov. 11, 2008 Jacobson |
| 9,206,022 B66D | Dec. 8, 2015 Burneister |
| 7,484,713 B66D | Feb. 3, 2009 Young |

BACKGROUND

Pullers are defined as a device that creates a drawing, tugging or hauling force on an object. Traditional pullers or winches are limited on the length they can pull an object due to storing the line on a drum. Electric winch or pullers are heavy, limiting mobility. Traditional winches and pullers are limited by power requirements or limited to a single power method. Traditional winches and pullers have only one rate of pull with only one gear ratio or rate of pull. Traditional winch and pullers have limited mounting options either by mounting with a single hook or are permanently mounted to an object such as a vehicle or trailer.

Several pullers have been proposed such as U.S. Pat. No. 9,150,392—Skyba, or U.S. Pat. No. 7,484,713—Young, that have ingenious features, increasing usability and versatility of pullers. The above patents fall short of creating a puller that is portable, multispeed, accepts multiple power inputs, and easily accepts multiple diameters of working lines.

SUMMARY

The Portable Endless Line Puller is a lightweight, multi speed portable, line puller designed to add extra pulling force, utilizing multiple gear ratios, and multiple powering methods, only limiting length of pull by the length of line.

Advantages

Thus several advantages of one or more aspects are that the Portable Endless Line Puller provides for multiple pull rates, is lighter thus more portable. The advantages of one or more of the aspects of the endless line winch are the pull length is only determined by the length of line used and the working line may be loaded on the embodiment midsection not requiring the end of the line. Creates a puller limited only by the length of line used, allows multiple mounting options, creates multiple gears or pulling speeds and power, can be operated manually or with electric assistance. Light weight and portable allows use in more remote locations adding value and mechanical advantage and other advantages of one or more aspects will become apparent from the consideration of the description and drawings.

DRAWINGS

DRAWINGS REFERENCE NUMBERS

Figure 1:
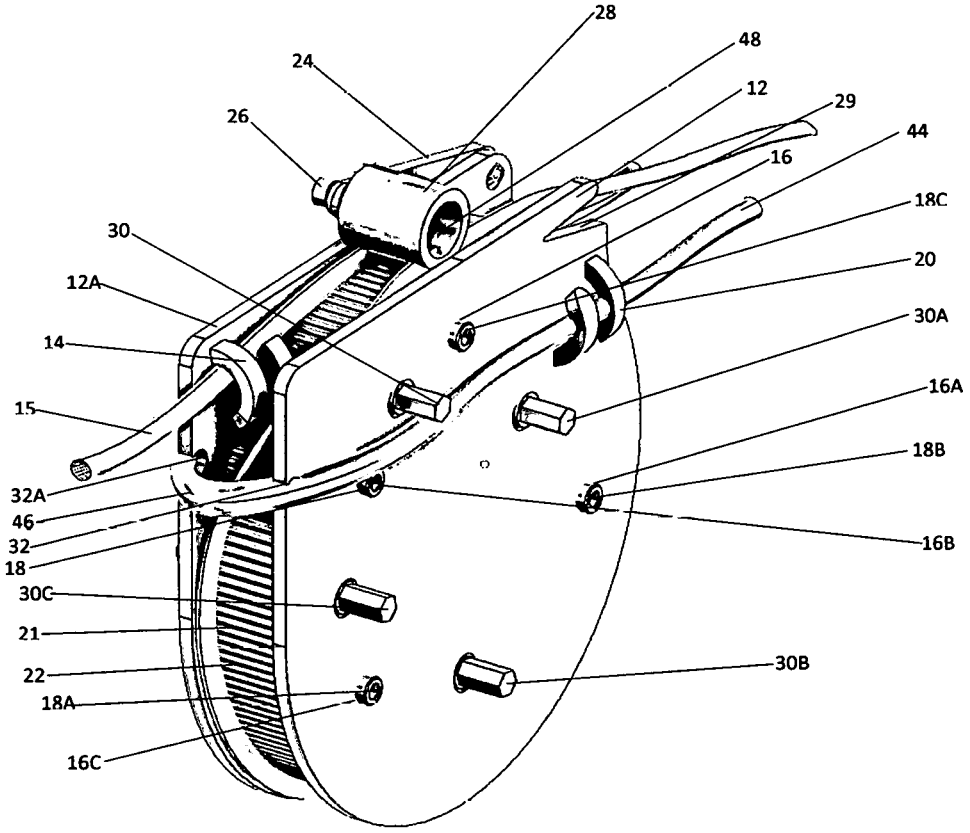
FIG. 1 Shows Perspective View of entire Embodiment
Figure 2:
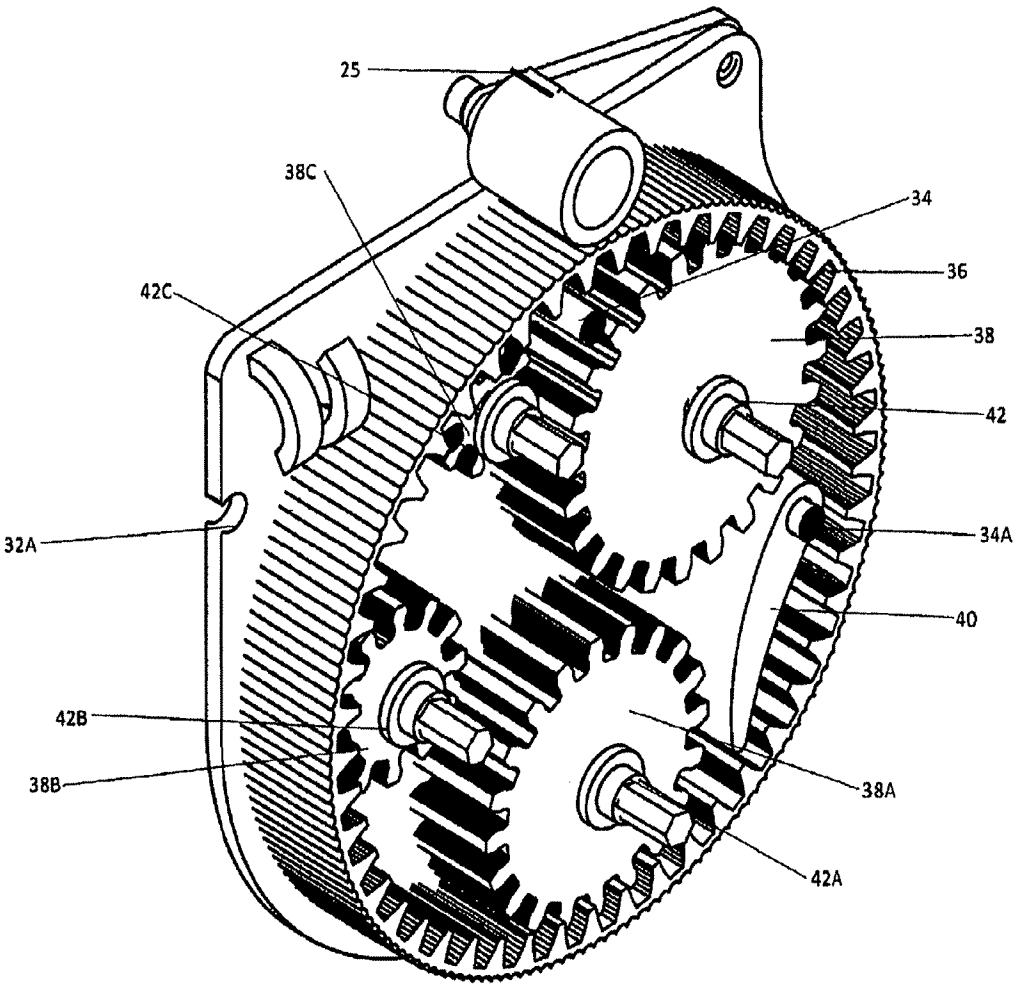
FIG. 2 Shows Perspective View of internal mechanism
Figure 3:
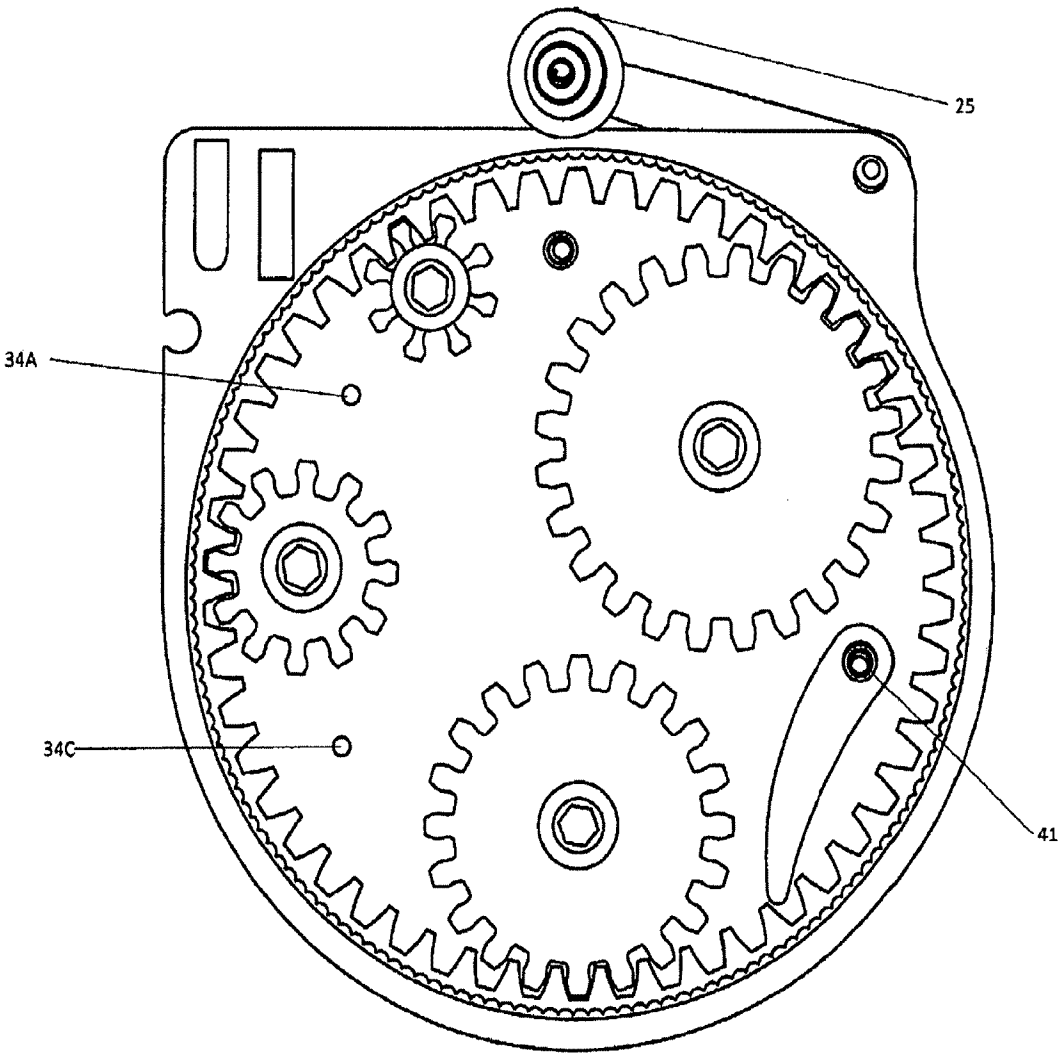
FIG. 3 Shows Side View of internal mechanism
Figure 4:
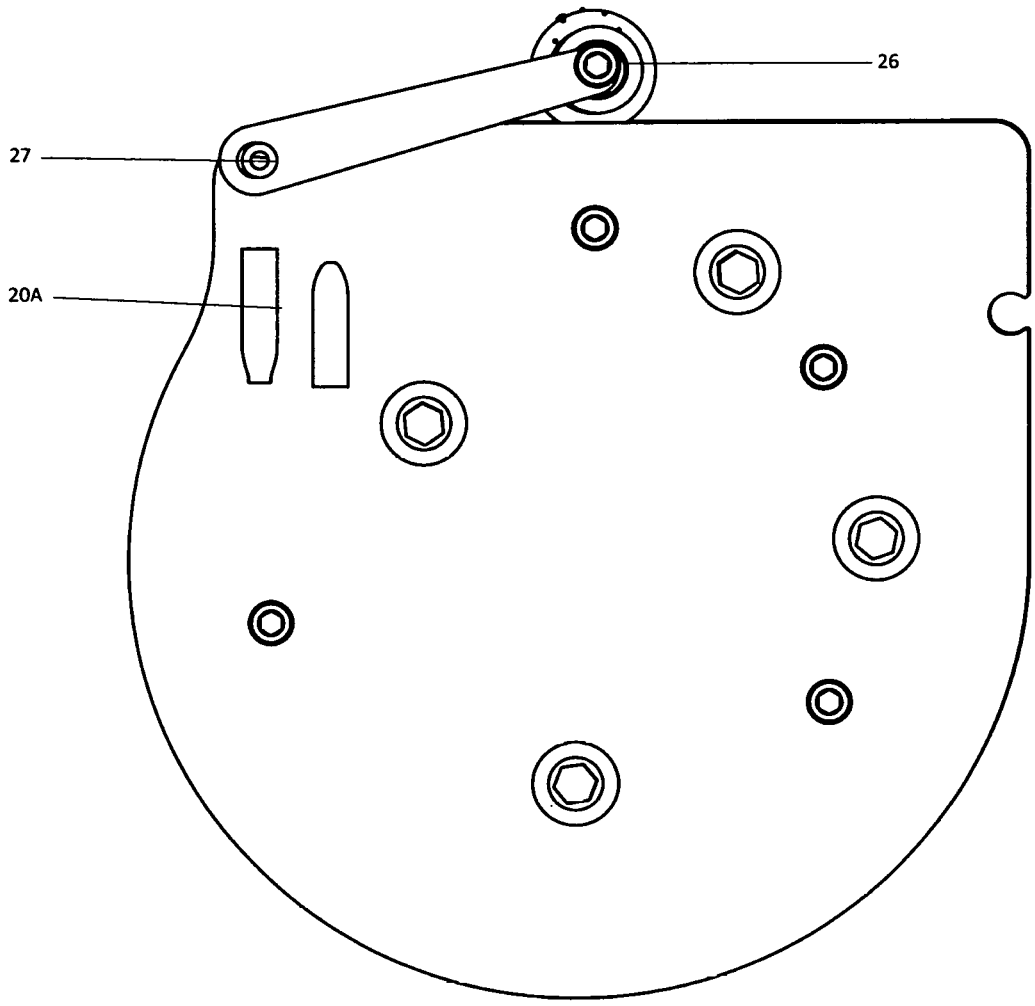
FIG. 4 Shows Back view of alternate side

12(*a*). Body Plate
14. Working Line Fairlead
15. Working Line
16(*a,b,c*). Axel Mounting Hole
18(*a.b.c*). Plate Fastener
20(*a*). Anchor Fairlead
21. Capstan
22. Texturing
24. Brake Lever
25. Torsion Spring (Pawl)
26. Brake Fastener
27. Brake Mounting Bolt
28. Brake
29. Secondary Brake
30(*a,b,c*). Drive Axel
32(*a*). Anchor Point
34(*a,b,c*). Standoff
36. Internal Cog
38(*a,b,c*). Drive Wheel
40. Internal Pawl
41. Torsional Spring
42(*a,b,c*). Bushing
44. Anchor Line
46. Purchase Attachment
48. One Way Bearing

DETAILED DESCRIPTION AND OPERATION

Body

The embodiment of the endless line winch consists of two plates that make up the body. The Body Plates (12, A) provide axel mounting holes (16, ABC). The Number of holes is a function the number of driver or idle mechanisms incorporated. The body plates provide a mounting point for a fairlead, for both a working and Anchor line. The Working Line and Anchor fairlead (20, A) is formed from opposing tabs cut out of the Body Plates. The tabs are pressed in a radial fashion such as to contain the Working Line (15) or Anchor Line, but allows removal and installation without the line termination. The Working Line is any elongated flexible member such as a rope or wire. The holes in the Body Plates provide bearing surfaces for a drive axel. Drive Axels (30, ABC) transfer rotational force to a drive wheel. Drive Axels can contact the body directly or a bearing may be installed to reduce friction and prevent wear. Bearing may be made of any material such as metal or plastic and could resemble a bushing or a ball bearing. The foreseen embodiment of the bearings is seen to be plastic bushing (42, ABC). Drive Axels Transfer rotational power from a lever or external power source such as a power drill. Rotational power can be applied to bother ends of the Drive Axels. The Drive Wheels (38,ABC) transfer rotational movement from the drive axels to a Capstan. Drive wheels can be made of any material such as metal or plastic. Drive Wheels can transfer power to the capstan through mechanical or friction methods. Drive Wheels of different sizes translate different ratios to the Capstan (21). One embodiment of the Capstan is the have internal cogs (36) to receive power from said Drive Wheels. The Drive wheels support the Capstan due to the spacing of the mounting holes and the diameter of the drive surfaces. The Capstan receives rotational power from the Drive Wheels, creating a pulling force on any elongated member (Working Line (15)) wound around it's circumference. One embodiment of said capstan is to have texturing or material applied to increase friction. The Texturing (22) could be a knurling of the surface, cut grooves or additional material. Mounting holes located on the Body Plates proved locations to attach Plate Fasteners. The Plate Fasteners (18,ABC) connect the body and encompass a Standoff. One embodiment of said Plate Fasteners is a mechanical mechanism like a bolt and nut. The Standoff (34,ABC) is seen to be cylindrically shaped and slightly longer the the width of the Drive Wheels and Capstan. The standoff should allow fasteners to securely attach each side plate without producing unneeded compressional friction on the capstan or drive surfaces. An Internal Pawl could be installed using a Standoff as a bearing surface. The internal Pawl (40) is designed to eliminate reverse rotation. The Internal Pawl contacts the internal cogs on the capstan. The pawl is torsional loaded with a torsional Spring. The Torsional Spring (41) will apply effort to one side of the Pawl. The Pawl is then forced into contact with the Internal Cogs of the Capstan. The Internal Pawl is not limited to this embodiment. The Body Plates have a mounting hole for an external brake. The external Brake (28) is designed to keep the Tow Line in contact with the Capstan as well as prevent overrides. The External Brake thought to have an external surface designed to increase friction. This surface could be knurled or soft rubber. This embodiment is thought to have a One Way Bearing. The One Way Bearing would allow the external brake to rotate with the capstan and lock into place when capstans is not under rotation. Said Brake would be mounted on a Brake Lever with a Fastener. The Brake Lever (24) is mounted to the brake and to a Body Plate with a Fastener (26). The brake lever is loaded with a Torsion Spring. The Torsion Spring (25) is installed at the pivot point of said lever and on the body plate. The Torsional Spring forces contact between the external Brake and the Capstan or Working Line. The working line can be secured with a secondary brake. The Secondary Brake (29) comprises of an diminishing angled slot, cut into a body plate providing friction and compression as the working line progresses towards the narrowing end of the slot. This embodiment can be anchored with an Anchor Line. The Anchor Line (44) is thread through and Anchor Fairlead (20, A) Through the two Anchor Points (32, A) and through the second Anchor Fairlead (20,A). The Anchor Points and the Anchor Fairleads keep the device from rotating when torque is applied to the mechanism. The anchor Line between the Anchor Points creates a Purchase Attachment. The Purchase Attachment (46) creates an Attachment point for the end of the working line after running around a tow or through a block.

The above detailed description contains many specificities, these should not be construed as limitations on the scope, but rather as an exemplification of on embodiment thereof. Other embodiments may have features but not limited to such as molded body plates, molded standoff points, handles, meters, intergrated motors and such. Material body and components may differ.

The invention claimed is:

1. A machine, comprising:

a) a body of rigid material encompassing a cylindrical friction device, b) said cylindrical friction device rotates freely within said body, c) a plurality of drive wheels whereby said drive wheels are each contiguous with said cylindrical friction device, transferring rotational energy and providing support to said cylindrical friction device, d) a plurality of drive axles, each drive axle mounting and supporting a respective one of the plurality of drive wheels, e) each of the drive wheels meshing with the internal cog, and being rotationally fixed directly to the respective drive axle, f) each of said axels is mounted to said body, g) rotation is urged to one of said axels through external torque, h) the cylindrical friction device creates friction between an elongated flexible member wound around the circumference of said cylindrical friction device and said cylindrical friction device, i) force is applied to said elongated flexible member with a rotational limiting device, j) said rotational limiting device allows said elongated flexible member on said cylindrical friction device unidirectional movement, k) said rotational limiting device is mounted to said body, l) said machine configured such that a force may be exerted on an object through rotational movement of the cylindrical friction device.

* * * * *